US006255773B1

(12) United States Patent
Powers et al.

(10) Patent No.: US 6,255,773 B1
(45) Date of Patent: Jul. 3, 2001

(54) FIELD EMISSION DISPLAY HAVING A CATHODOLUMINESCENT ANODE

(75) Inventors: William C. Powers, Wareham; Robert Kozlowski, Concord, both of MA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/195,119

(22) Filed: Nov. 18, 1998

(51) Int. Cl.[7] ..... H01J 1/62
(52) U.S. Cl. ..... 313/496; 313/495
(58) Field of Search ..... 313/495, 496, 313/497, 422, 466, 474, 493, 292

(56) References Cited

U.S. PATENT DOCUMENTS

| | | | | |
|---|---|---|---|---|
| 5,103,144 | | 4/1992 | Dunham | 315/366 |
| 5,262,698 | | 11/1993 | Dunham | 315/169.1 |
| 5,543,691 | | 8/1996 | Palevsky et al. | 315/366 |
| 5,734,224 | * | 3/1998 | Tagawa et al. | 313/495 |
| 5,777,432 | * | 7/1998 | Xie | 313/495 |
| 5,814,934 | * | 9/1998 | Tsai | 313/496 |

* cited by examiner

*Primary Examiner*—Ashok Patel
*Assistant Examiner*—Joseph Williams
(74) *Attorney, Agent, or Firm*—Daly, Crowley & Mofford, LLP

(57) ABSTRACT

A cathodoluminescent anode for a field emission display (FED) includes a substrate on which an array of phosphor elements is formed, with at least two such elements spaced by a gap adapted to receive a spacer when the anode is assembled to a cathode. In one embodiment, a conductive layer disposed over the phosphor elements has a portion disposed in the gap, in contact with and electrostatically and mechanically bonded to the substrate. In another embodiment, the conductive layer has an aperture in the gap to expose a portion of the substrate. Also described are techniques for fabricating the FED anodes.

5 Claims, 5 Drawing Sheets

FIELD EMISSION DISPLAY HAVING A CATHODOLUMINESCENT ANODE

CROSS-REFERENCE TO RELATED APPLICATIONS

This application is a continuation-in-part of U.S. patent application No. 09/104,684, filed on Jun. 25, 1998.

STATEMENTS REGARDING FEDERALLY SPONSORED RESEARCH

This invention was made with government support under Contract No. TRP MDA972-95-3-0026 awarded by the Defense Advanced Research Project Agency (DARPA). The government may have certain rights in this invention.

BACKGROUND OF THE INVENTION

As is known in the art, field emission displays (FEDs) are a type of cathode ray tube which include a cathode comprising a dielectric substrate on which an array of field emission elements are formed and a cathodoluminescent anode comprising a dielectric substrate on which an array of phosphor elements are formed. In assembly, the anode and cathode structures are bonded together so that the field emission elements face the phosphor elements and the enclosed structure is evacuated. In a color FED, each pixel includes phosphor elements of different colors. Typically, each set of a red, a green, and a blue phosphor element forms a pixel. Control electrodes control the flow of electrons between the field emission elements and respective pixels.

The voltage between the FED anode and cathode determines the brightness of the display. In particular, the higher the operating voltage, the brighter the display. Operating voltages between 4KV and 10KV are desirable.

The size and spacing of the phosphor elements, as well as the physical separation between the anode and cathode, affect the display resolution. In particular, the closer the anode and cathode, the higher the resolution. However, as such spacing gets smaller, the likelihood of arcing, particularly at high operating voltage levels, increases. Suitable anode to cathode separation for operating voltages of 4–10KV is on the order of 3–4 millimeters.

Spacers are sometimes positioned between the anode and the cathode in order to accurately and reliably maintain the small separation between these structures. In one such arrangement, the spacers are attached to the cathode substrate and, when the anode and cathode structures are bonded together and the tube is evacuated, the spacers come into contact with the anode.

One technique for forming a cathodoluminescent anode includes depositing a phosphor and photoresist slurry onto a dielectric substrate and then patterning the layer, such as with the use of photolithography, in order to provide the phosphor pixel elements. These steps may be repeated multiple times using different slurries in order to provide the different colors comprising the pixels. A layer of lacquer is applied over the phosphor elements in order to provide a relatively smooth surface for the subsequent application of a conductive layer, such as aluminum applied by evaporation. The structure is then baked at a temperature between 400° C. and 450° C. to remove any organics, including the lacquer and any photoresist, which causes the aluminum layer to be held onto the substrate and phosphor elements by electrostatic forces.

The force of the spacers against the aluminum layer can cause loose particles of aluminum to be generated. Loose particles can cause the anode and cathode to become electrically shorted together, thereby resulting in dead areas on the display. Such particles can also cause stray emissions resulting in illumination of areas of the display that should not be illuminated. Further, the loose particles can cause arcing which, in turn can cause more loose particles to be generated.

SUMMARY OF THE INVENTION

According to the invention, a cathodoluminescent anode for use in an FED includes a substrate on which an array of phosphor elements is provided to form pixels. At least a pair of the phosphor elements is spaced by a gap into which a spacer will extend in assembly. A conductive layer is disposed over the phosphor elements, with a portion disposed in the gap, in contact with the substrate. In assembly, the anode is bonded to a cathode having a spacer, such that the spacer extends into the gap to contact the conductive layer.

With this arrangement, the conductive layer is securely, electrostatically and mechanically bonded to the substrate in the gap. Thus, when the conductive layer is contacted by the spacer in assembly, loose conductive particles do not tend to be generated. This is in contrast to conventional cathodoluminescent anodes for FEDs in which the conductive layer is held onto the anode by electrostatic forces and contact by the spacer tends to generate loose conductive particles.

In accordance with a further embodiment of the invention, a conductive layer disposed over the phosphor elements has an aperture in the gap between adjacent phosphor elements, so as to expose a portion of the substrate in the gap. In assembly, the anode is bonded to a cathode having a spacer, such that the spacer extends into the gap to contact the substrate. Since the spacer does not contact the conductive layer, loose conductive particles are not generated.

Also described are techniques for fabricating a cathodoluminescent anode. In accordance with one such technique, a plurality of phosphor elements are provided in a pattern on a substrate, with a gap between a pair of the phosphor elements. A lacquer is applied over the phosphor elements and a portion of the lacquer in the gap is removed, such as with the use of photolithography. A conductive layer is deposited over the structure so that a first portion of the conductive layer is disposed in the gap in contact with the substrate and a second portion of the conductive layer is disposed over the lacquer. The structure is then baked to remove of the lacquer.

According to an alternative technique, a lacquer is applied over the phosphor elements and a conductive layer is deposited over the lacquer. Thereafter, a portion of the conductive layer disposed in a gap between adjacent phosphor elements is removed, such as by reactive ion etching.

BRIEF DESCRIPTION OF THE DRAWINGS

The foregoing features of this invention, as well as the invention itself, may be more fully understood from the following description of the drawings in which.

DETAILED DESCRIPTION OF THE INVENTION

Figure 1:
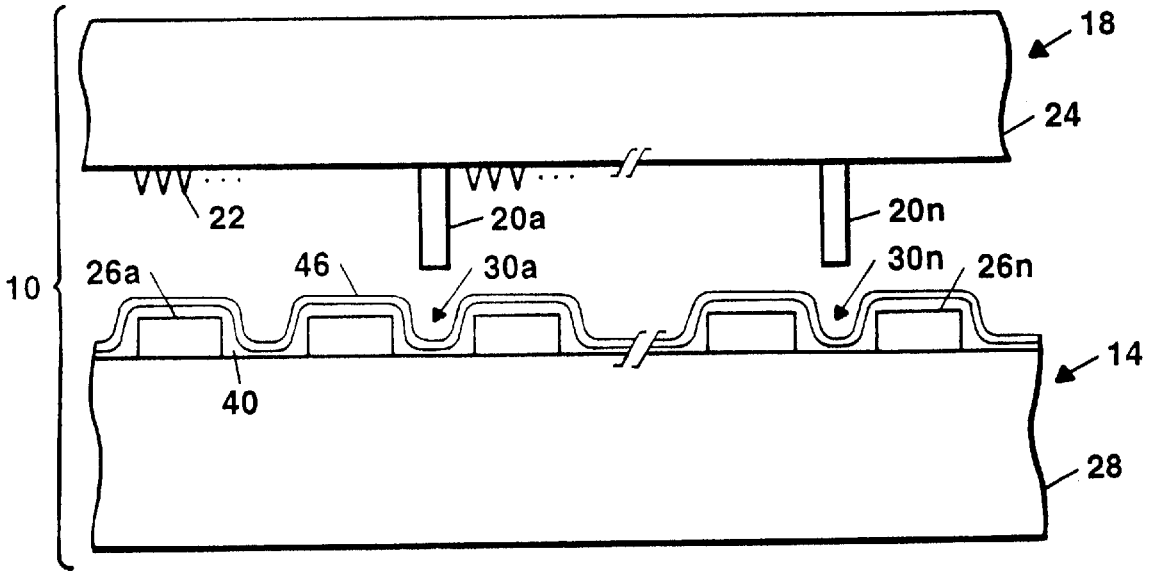
FIG. 1 is an exploded view of an FED utilizing spacer technology.

Referring to FIG. 1, a field emission display (FED) 10 includes a conventional cathodoluminescent anode 14 and a cathode 18 having a plurality of stand-offs, or spacers 20*a*–20*n*. The cathode 18 further includes a plurality of field emission elements 22, sometimes referred to as tips, disposed on a dielectric substrate 24. The anode 14 includes a plurality of ti-color phosphor elements 26*a*–26*n* disposed on a dielectric substrate 28 and covered with a conductive layer 46 through which electrons from the cathode are directed to impinge on the phosphor elements. The illustrative display 10 is a color display with each of the phosphor elements forming a sub-pixel, and each set of a red, a green, and a blue phosphor element comprising a pixel. One such FED is described in U.S. Pat. No. 5,543,691, entitled "Field Emission Display with Focus Grid and Method of Operating Same," with inventors Alan Palevsky and Peter Koufopoulos, issued Aug. 6, 1996, assigned to the same assignee as the present invention, and incorporated herein by reference in its entirety.

The anode 14 is formed by depositing a phosphor and photoresist slurry onto a glass substrate 28 and then patterning the phosphor to form individual elements 26*a*–26*n*, such as with the use of conventional photolithography techniques, with adjacent phosphor elements spaced by gaps. A layer of lacquer 40 is applied over the phosphor elements 26*a*–26*n* and dried, following which a conductive layer 46 is deposited over the structure, such as aluminum deposited by chemical vapor deposition. The structure is then baked at a temperature of between 400° C. and 450° C. which causes organics, including the lacquer and any photoresist, to evaporate. Once the lacquer is removed, the conductive layer 46 is held onto the phosphor elements 26*a*–26*n* and the substrate in the gaps between phosphor elements by electrostatic forces.

In assembly, the anode 14 and the cathode 18 are bonded together, with one or more spacers 20*a*–20*n* vertically aligned with a respective gap 30*a*–30*n* between adjacent phosphor elements 26*a*–26*n*. The device is then placed in an evacuation chamber which is pumped down to create a vacuum in the interior of the assembled structure, which causes the spacers 20*a*–20*n* to contact the anode and, in particular, to contact the aluminum layer 46 of the anode.

The force of the spacers 20*a*–20*n* against the aluminum layer 46 can cause loose particles of aluminum to be generated. Loose particles can cause the anode and cathode to become electrically shorted together, thereby resulting in dead areas on the display. Such particles can also cause stray emissions, resulting in illumination of areas of the display that should not be illuminated. Further, the loose particles can cause arcing which, in turn can cause more loose particles to be generated.

Figure 2:
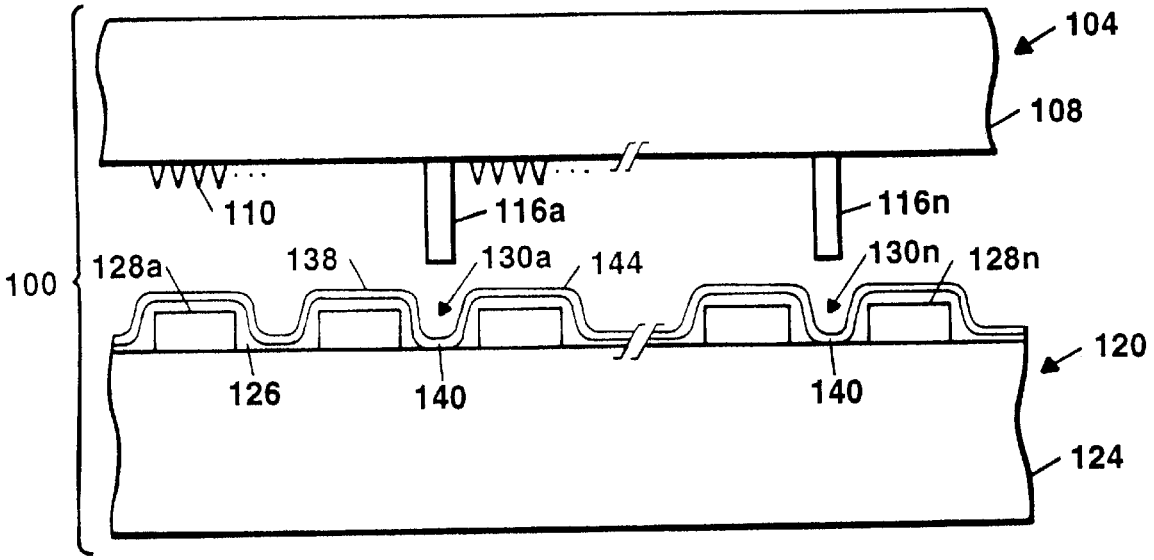
FIG. 2 is an exploded view of an FED including an anode according to the invention.

Referring to FIG. 2, an FED 100 according to the invention includes an anode 120 and a cathode 104. The cathode 104 includes a glass substrate 108 having a plurality of field emission elements 110 and at least one spacer 116*a*–116*n* attached thereto. The spacers 116*a*–116*n* are fabricated from a dielectric material and are attached to the substrate 108 by various techniques, such as with the use of cyano acrylate.

The anode 120 includes a glass substrate 124 on which a plurality of phosphor elements 128*a*–128*n* are formed as will be described. Adjacent phosphor elements 128*a*–128*n* are thus spaced by gaps. At least one, and in the illustrative embodiment, a plurality of the gaps between adjacent phosphor elements, labelled 130*a*–130*n*, will have a spacer 116*a*–116*n*, respectively, disposed therein when the anode 120 is bonded to the cathode 104.

A layer of a lacquer compound 126 is deposited over the phosphor elements 128*a*–128*n* and portions of the lacquer compound 126 disposed in the gaps 130*a*–130*n* are removed prior to application of a conductive layer 138. Thus, the conductive layer 138 is disposed in contact with the substrate 124 in the gaps 130*a*–130*n*. More particularly, first portions 140 of the conductive layer 138 are disposed directly over and in contact with the substrate 124 and second portions 144 of the conductive layer 138 are initially disposed over portions of the lacquer.

Figure 2A:
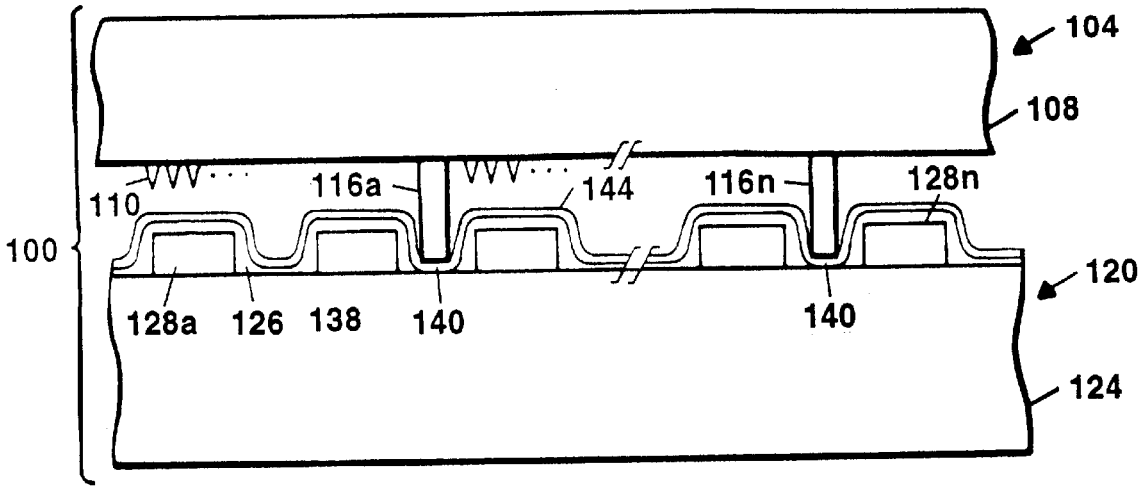
FIG. 2A shows the assembled FED of FIG. 2.

Referring also to FIG. 2A, in assembly, when the anode 120 and cathode 104 are bonded together, each of the spacers 116*a*–116*n* is disposed in a corresponding one of the gaps 130*a*–130*n*. More particularly, when the device 100 is evacuated, the spacers 116*a*–116*n* contact the conductive layer portions 140, as shown.

With this arrangement, portions 140 of the conductive layer 138 are electrostatically and mechanically bonded and thus, securely attached to the anode substrate 124 in the gaps 130*a*–130*n* where the spacers 116*a*–116*n* contact the anode in assembly. This arrangement is in contrast to a conventional electrostatic bond between the conductive layer and the substrate. The resulting stronger bond between the conductive layer and the substrate prevents loose particles from being generated when the spacers 116*a*–116*n* contact the conductive layer portions 140 in the gaps 130*a*–130*n*.

Figure 3:
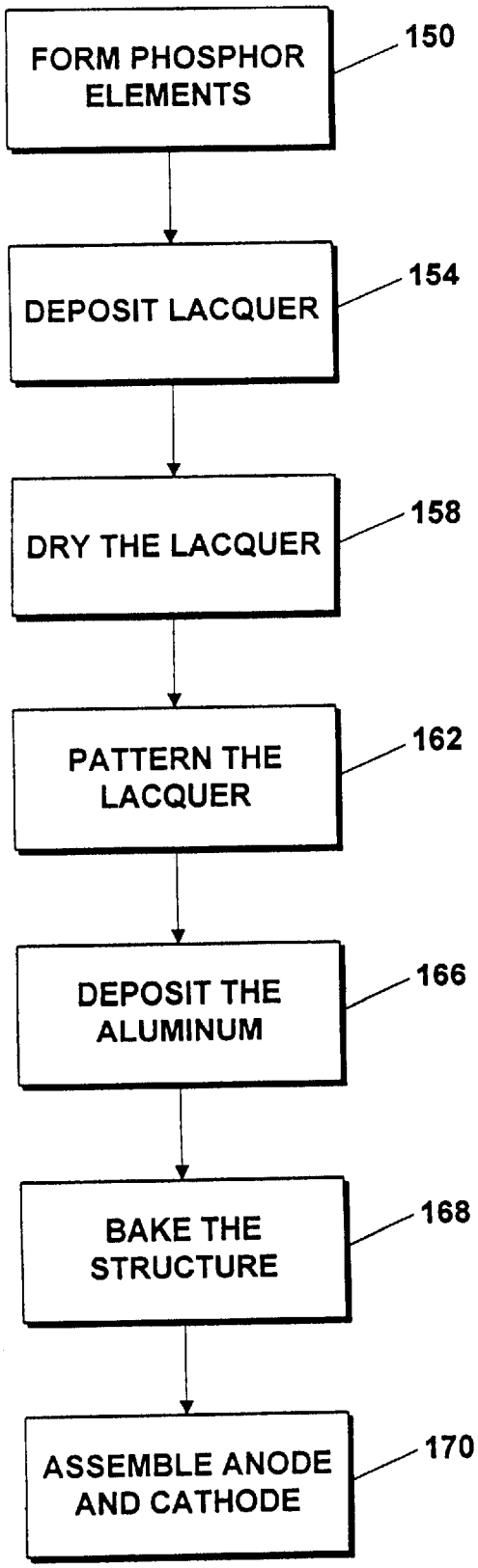
FIG. 3 is a flow diagram of a process for fabricating the FED anode of FIG. 2.

Referring also to FIG. 3, a method for fabricating the FED anode 120 of FIGS. 2 and 2A is illustrated. Initially, the tri-color phosphor elements 128*a*–128*n* are formed on the glass substrate 124 in step 150. Various techniques are suitable for forming the phosphor elements. As one example, a slurry comprising phosphor and photoresist is applied to a cleaned surface of the substrate 124. One such slurry includes, for a green phosphor, 520 grams of phosphor particles, 550 grams of deionized water, 300 grams of poly-vinyl alcohol (PVA 523 by Air Products) 10% stock, 24 grams ammonium dichromate (ADC) 10% stock, 2.0 grams 1,4-butane diol, one drop CF-10 manufactured by Union Carbide, and one drop Tween 20 (i.e., Polysorbate 20) manufactured by ICI Surfactants, Wilmington, Delaware. The first step in preparing the slurry is to measure the phosphor desired and deionized water into a one liter amber plastic container. The mixture is placed on a roller for one hour before proceeding. The PVA, ADC, Diol, CF-10 and Tween 20 are added to the mixture. The mixture is rolled for at least one hour and strained through a 200 mesh screen before using. It is noted that the solution must be kept on rollers continuously in order to keep the phosphor in suspension.

The slurry is then dried, for example, at a temperature on the order of 400° F., and the dried layer is patterned using conventional photolithographic techniques, to form the phosphor elements 128*a*–128*n*. To this end, a mask is deposited over portions of the dried slurry layer and the structure is subjected to ultraviolet light. The mask and un-polymerized phosphor portions covered by the mask are removed. This technique is repeated using different slurries to form the different color phosphor elements.

The size and spacing of the phosphor elements is a function of the desired display resolution. In the illustrative embodiment, each phosphor element 128*a*–128*n* has a width on the order of 195 microns and a spacing between adjacent elements on the order of 45 microns.

In subsequent step 154, the lacquer compound 126 is deposited in order to provide a smooth surface for subsequent application of the conductive layer 138. The lacquer compound includes a lacquer (e.g., resin particles suspended in a solvent) and photoresist to facilitate removal of portions of the lacquer in step 162. The lacquer compound may additionally include (or be applied with) a binder as described in a co-pending U.S. application Ser. No. 09/104,684 entitled "CRT Lacquer," with inventor William Powers, assigned to the same assignee as the present invention and incorporated herein by reference in its entirety. One such binder is provided by particles of an inorganic material, such as potassium silicate. The lacquer compound is flow coated and spun in order to provide a layer of substantially uniform thickness on the order of 0.003 to 0.005 inches.

In step 158, the lacquer compound 126 is dried. In the illustrative embodiment, the lacquer is dried at a temperature on the order of 500° F. to 550° F. using a ceramic plate heater for a duration on the order of 3 to 5 minutes. This drying step causes the lacquer solvent to evaporate.

In step 162, the lacquer compound 126 is patterned in order to remove portions disposed in the gaps 130*a*–130*n* between the phosphor elements into which the spacers 116*a*–116*n* will extend in assembly. Various techniques may be used to remove such portions of the lacquer layer 126. In the illustrative embodiment, photolithography is used. To this end, in step 162, a mask is deposited over areas of the lacquer layer which will be removed (i.e., in the gaps 130*a*–130*n*). The structure is then subjected to ultraviolet light following which the mask and un-polymerized lacquer portions under the mask are removed.

In step 166, a conductive layer 138 is deposited over the structure by any of various conventional techniques, such as evaporation or chemical vapor deposition. In the illustrative embodiment, the conductive layer 138 is comprised of aluminum applied by evaporation in a vacuum chamber which is pumped down to $5\times10^{-5}$ T. The thickness of the aluminum layer 138 is a function of the desired reflectivity and operating voltage.

In the illustrative embodiment, the aluminum layer 138 has a thickness on the order of between 600 and 2500 Angstroms and the device operates in the voltage range of between 4 and 10 KV. At this point in the process, the aluminum layer 138 has portions 144 disposed over lacquer and portions 140 disposed in the gaps 130*a*–130*n*, in contact with and electrostatically and mechanically bonded to the substrate 124.

Subsequently, in step 168, the structure is baked to remove any organic substances, including any photoresist and lacquer. In the illustrative embodiment, the structure is baked at a temperature on the order of 400° to 425° C. for a duration on the order of four hours. When the lacquer compound includes (or is applied with) a binder, the binder is not removed by this baking step. Thus, in this case, the portions 140 of the aluminum layer disposed in the gaps 130*a*–130*n* are electrostatically and mechanically bonded to the substrate 124 (since the lacquer compound including the binder is removed in these areas in step 162) and the portions 144 of the aluminum layer disposed elsewhere are electrostatically and mechanically bonded to the anode by the binder. Whereas, when the lacquer compound does not include a binder, the portions 140 of the aluminum layer are electrostatically and mechanically bonded to the substrate, but the portions 144 of the aluminum layer are electrostatically bonded to the anode.

In step 170, the cathode 104 and anode 120 are bonded together to provide the structure shown in FIG. 2A. As noted above, with this arrangement, the spacers 116*a*–116*n* are disposed in contact with the portions 140 of the aluminum layer 138 which are electrostatically and mechanically bonded to the substrate 124. Because of the relatively strong bond between the aluminum and the substrate in these areas, the force of the spacers 116*a*–116*n* against the aluminum portions 140 does not tend to generate loose aluminum particles.

Figure 4:
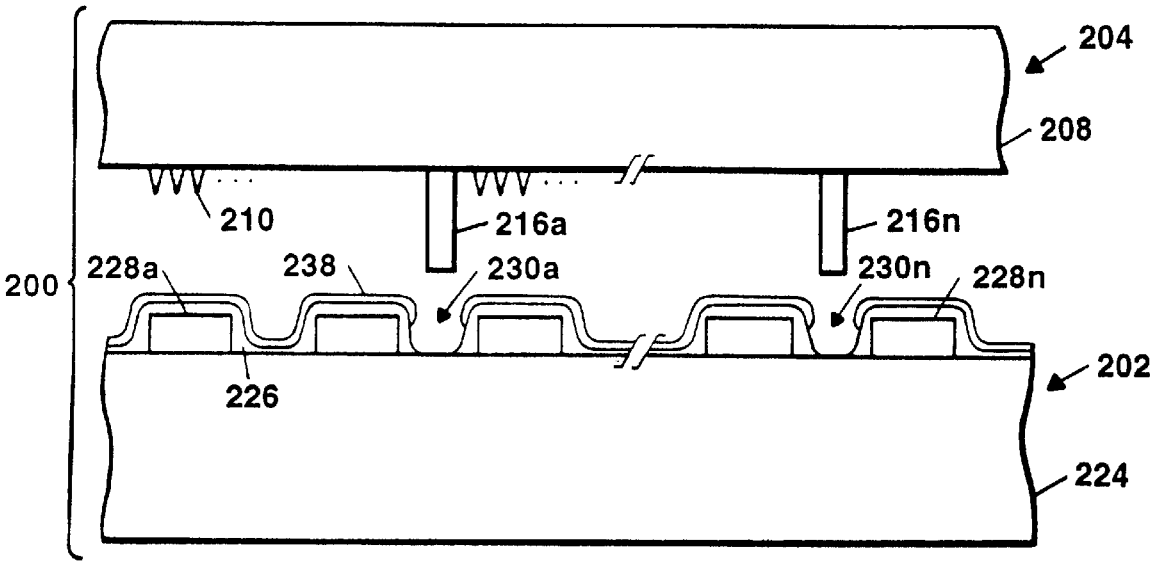
FIG. 4 is an exploded view of an FED including an anode according to a further embodiment of the invention.

Referring to FIG. 4, an FED 200 according to a further embodiment of the invention includes an anode 202 and a cathode 204. The cathode 204 is identical to the cathode 104 of FIG. 2 and thus, includes at least one spacer 216*a*–216*n* and a plurality of field emission elements 210 attached to a glass substrate 208. The anode 202 includes a glass substrate 224 on which a plurality of phosphor elements 228*a*–228*n* are formed.

At least one and, in the illustrative embodiment, a plurality of the gaps between adjacent phosphor elements, labeled 230*a*–230*n*, will have a spacer 216*a*–216*n* disposed therein in assembly.

A layer comprising a lacquer 226 is applied over the phosphor elements 228*a*–228*n* in order to provide a substantially smooth surface. Optionally, a binder material may be applied with the lacquer, as described below in conjunction with FIG. 5. A conductive layer 238 is deposited over the lacquer layer 226 and portions of the layer 238 in the gaps 230*a*–230*n* are removed. A subsequent baking step causes the lacquer to be removed.

Figure 4A:
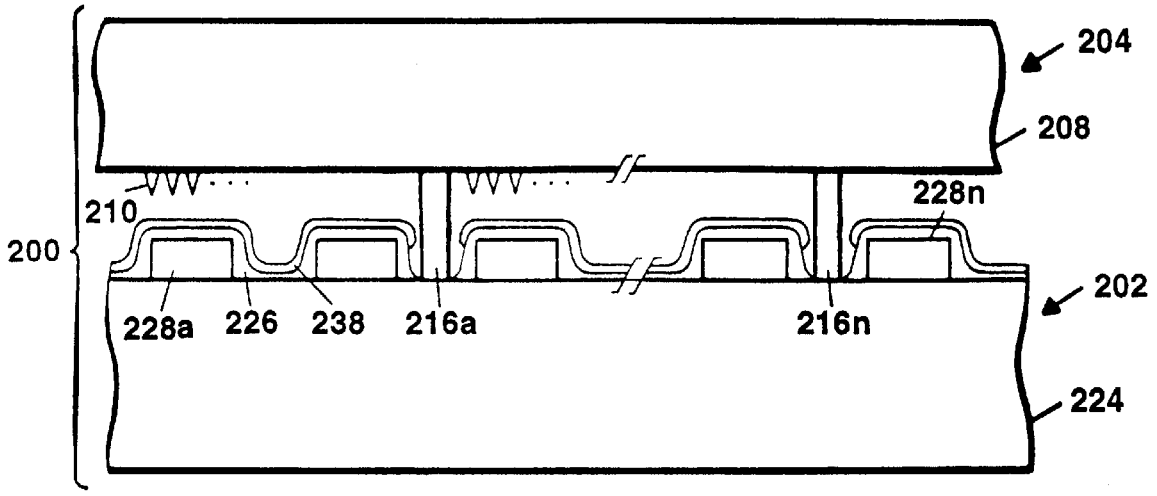
FIG. 4A shows the assembled FED of FIG. 4.

As shown in FIG. 4A, in assembly, when the anode 202 and cathode 204 are bonded together, each of the spacers 216*a*–216*n* contacts the anode substrate 224 (or a binder) in a respective gap 230*a*–230*n*. as shown. Since the spacers 216*a*–216*n* do not contact the conductive layer 238, loose conductive particles are not generated.

Figure 5:
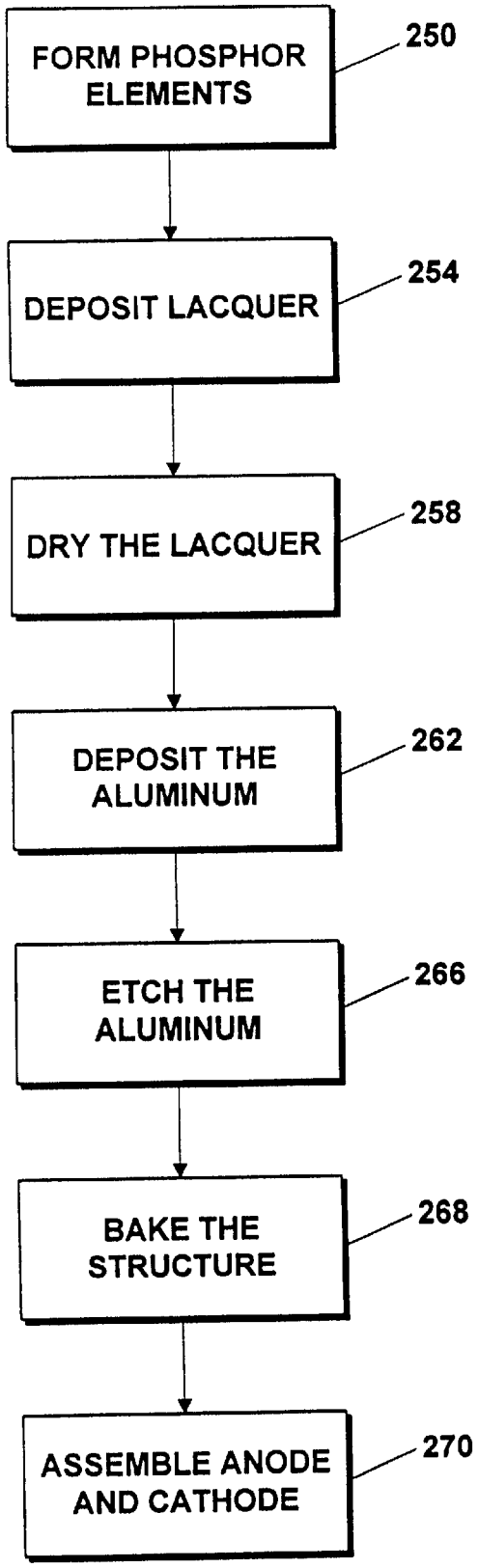
FIG. 5 is a flow diagram of a process for fabricating the FED anode of FIG. 4.

Referring to FIG. 5, a process for fabricating the FED 200 of FIGS. 4 and 4A begins with step 250, in which the phosphor elements 228*a*–228*n* are formed on the substrate 224 in the same manner described above in conjunction with step 150 of FIG. 3. Thereafter, the lacquer 226 is deposited in step 254 and subsequently dried in step 258. The lacquer is a conventional water or solvent based lacquer and, may be applied with a binder material as described in conjunction with the above-referenced U.S. patent application No. 09/104,684 which is incorporated herein by reference in its entirety. As one such example, the lacquer layer 226 comprises a lacquer and a binder. In particular, the lacquer is an organic material, here a mixture of Acrysol AC73 by Rohm and Hass and Butyl Cellosolve. The binder is an inorganic material, here potassium silicate. Also included is deionized water.

More particularly, the lacquer includes 225 grams AC73 acrylic emulsion, 8 grams butyl cellosolve, 225 grams deionized water and 45 grams of Kasil solution. The procedure to form the lacquer includes the steps of: placing a mixture of butyl cellosolve, Zacsil 200 solution by Zaclon and deionized water into a 500 ml beaker; in a 500 ml beaker, measuring out the AC73 and slowly adding the deionized water/butyl cellosolve/Kasil mixture to the AC73 while mixing; mixing the solution fifteen minutes, filtering the solution through a 50 micrometer mesh screen; and storing the screened solution in a one liter plastic container.

In step 262, the aluminum layer 238 is deposited over the lacquer layer 226 by any conventional technique, such as chemical vapor deposition as described above in conjunction with step 166 of FIG. 3. In step 266, portions of the aluminum layer 238 disposed in the gaps 230*a*–230*n* are removed. Various techniques are suitable for removing these portions of the aluminum layer, including plasma etching, lift off or chemical etching. In the illustrative embodiment, reactive ion etching is used to remove the aluminum in the gaps 230*a*–230*n*. To this end, an etch resistant material is deposited over the anode such that the gaps 230*a*–230*n* are left exposed. Subsequently, a chemical etchant is applied to the structure, thereby removing the exposed aluminum in the gaps 230*a*–230*n*.

In step 268, the structure is baked to remove any organic substances, including the lacquer. Thus, when a binder is applied with the lacquer, the aluminum is chemically bonded to the anode by the binder. Whereas, when a binder is not used, the aluminum is electrostatically bonded to the anode. In the illustrative embodiment, the structure is baked at a temperature of between 400° and 425° C. for a duration on the order of 4 hours.

Finally, in step 270, the anode 202 and cathode 204 are assembled together and the structure is evacuated to provide the FED 200 of FIG. 4A. As is apparent from FIG. 4A, the spacers 216*a*–216*n* do not contact aluminum and thus, the tendency of the spacers to generate loose aluminum particles is eliminated.

Figure 6:
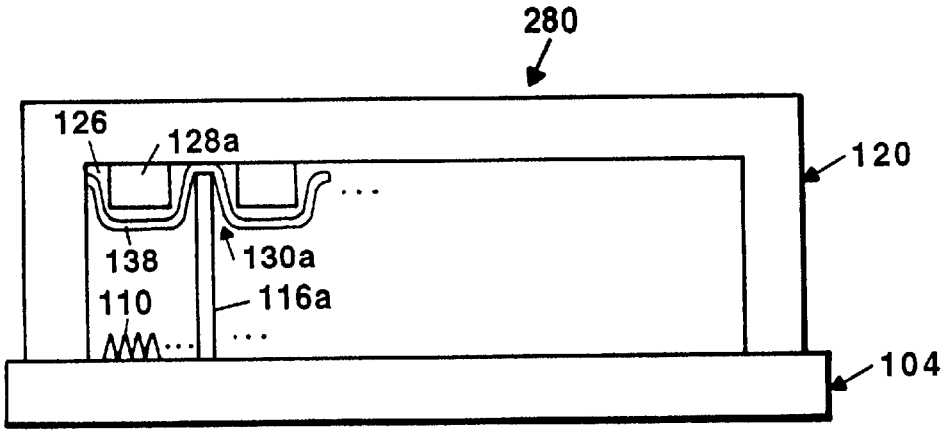
FIG. 6 shows an illustrative flat panel display utilizing an FED according to the invention.

Referring to FIG. 6, a flat panel display 280 includes an FED 100 of the type described above in conjunction with FIGS. 2 and 2A. Thus, the anode 120 includes phosphor elements 128*a*–128*n* over which lacquer layer 126 is disposed. Aluminum layer 140 is disposed over the lacquer layer 126 with first portions 140 of the aluminum layer disposed in the gaps 130*a*–130*n* in contact with, and electrostatically and mechanically bonded to, the substrate 124. The cathode 104 includes a plurality of field emission tips 110 and at least one spacer 116*a*. In assembly, the anode 120 and cathode 104 are brought into alignment such that the spacer 116*a* extends into a respective gap 130*a* and are bonded together by any suitable means.

Having described the preferred embodiments of the invention, it will now become apparent to one of ordinary skill in the art that other embodiments incorporating their concepts may be used. It is felt therefore that these embodiments should not be limited to disclosed embodiments, but rather should be limited only by the spirit and scope of the appended claims. All publications and references cited herein are expressly incorporated herein by reference in their entirety.

What is claimed is:

1. A cathodoluminescent anode comprising:

a substrate;

a plurality of phosphor elements disposed on said substrate, at least a pair of said phosphor elements being spaced a gap; and a conductive layer disposed over said phosphor elements and said substrate and having an aperture at a location corresponding to said gap to expose a portion of said substrate.

2. The anode of claim 1 wherein said conductive layer is attached to said phosphor elements by electrostatic forces.

3. The anode of claim 1 wherein said conductive layer is electrostatically and mechanically bonded to said phosphor elements.

4. The anode of claim 1 wherein said conductive layer is comprised of aluminum.

5. A field emission display comprising:

(a) a cathode comprising:
  (i) a substrate;
  (ii) a plurality of field emission elements attached to said substrate; and
  (iii) at least one spacer attached to said substrate; and (b) an anode comprising:
  (i) a substrate;
  (ii) a plurality of phosphor elements disposed on said substrate, at least a pair of said phosphor elements being spaced by a gap; and
  (iii) a conductive layer disposed over said phosphor elements and said anode substrate and having an aperture in a region corresponding to said gap to expose a portion of said substrate, wherein said at least one spacer contacts said exposed portion of said substrate when said anode and cathode are bonded together.

* * * * *